US006070827A

United States Patent [19]

Spahlinger et al.

[11] Patent Number: 6,070,827

[45] Date of Patent: Jun. 6, 2000

[54] YARN WINDING MACHINE

[75] Inventors: Jorg Spahlinger, Wermelskirchen; Roland Kampmann, Witten; Klemens Jaschke, Huckeswagen, all of Germany

[73] Assignee: Barmag AG, Remscheid, Germany

[21] Appl. No.: 09/297,436

[22] PCT Filed: Aug. 21, 1998

[86] PCT No.: PCT/EP98/05341

§ 371 Date: May 11, 1999

§ 102(e) Date: May 11, 1999

[87] PCT Pub. No.: WO99/12837

PCT Pub. Date: Mar. 18, 1999

[30] Foreign Application Priority Data

Sep. 11, 1997 [DE] Germany ..... 197 39 844

[51] Int. Cl.[7] ..... B65H 54/22

[52] U.S. Cl. ..... 242/474.5; 242/474.7; 242/475.7; 242/476.4; 242/157 R

[58] Field of Search ..... 242/474.5, 474.7, 242/475.7, 476.4, 157 R

[56] References Cited

U.S. PATENT DOCUMENTS

| | | | |
|---|---|---|---|
| 4,216,920 | 8/1980 | Tambara et al. . | |
| 4,969,607 | 11/1990 | Busenhart et al. | 242/474.5 |
| 5,016,829 | 5/1991 | Schippers et al. . | |
| 5,029,762 | 7/1991 | Behrens et al. . | |
| 5,219,125 | 6/1993 | Rigg | 242/474.5 |
| 5,344,090 | 9/1994 | Nakai et al. | 242/474.5 |
| 5,526,995 | 6/1996 | Westrich et al. | 242/474.5 |
| 5,566,904 | 10/1996 | Hashimoto | 242/474.5 |
| 5,716,016 | 2/1998 | Iwade et al. | 242/474.5 |
| 5,779,170 | 7/1998 | Siepmann et al. | 242/474.5 X |

FOREIGN PATENT DOCUMENTS

| | | |
|---|---|---|
| 0 374 536 | 6/1990 | European Pat. Off. . |
| 195 20 285 | 6/1996 | Germany . |
| 2 015 046 | 9/1979 | United Kingdom . |
| WO89 07573 | 8/1989 | WIPO . |

*Primary Examiner*—Donald P. Walsh
*Assistant Examiner*—Minh-Chau Pham
*Attorney, Agent, or Firm*—Alston & Bird LLP

[57] ABSTRACT

A yarn winding machine for winding a continuously advancing yarn to a package, wherein the package is wound on a tube mounted on one of two winding spindles. The winding spindles are mounted in cantilever fashion for rotation on a spindle turret. To be able to perform a yarn transfer from a full package mounted on one of the winding spindles to an empty tube mounted on the other winding spindle by rotating the spindle turret, the winding machine includes a yarn transfer device, which is rotated from an idle position to a deflecting position. The deflecting position is defined by a stop arranged on the spindle turret, so that during the rotation of the spindle turret the deflecting position is varied according to the rotation of the spindle turret.

15 Claims, 7 Drawing Sheets

YARN WINDING MACHINE

BACKGROUND OF THE INVENTION

The present invention relates to a yarn winding or takeup machine for winding a continuously advancing yarn to a package.

A yarn winding or takeup machine of the described type is disclosed in EP 0 374 536 and corresponding U.S. Pat. No. 5,029,762. In this machine, a continuously advancing yarn is wound to a package. After the package is fully wound, a transfer occurs automatically from the full package to an empty tube. To this end, the full package and the empty tube are each supported on a winding spindle, each winding spindle being mounted in cantilever fashion for rotation on a spindle turret. To transfer the yarn, the full package is rotated by rotating the spindle turret from the winding range to a transfer range, and the empty tube from the transfer range to the winding range. Once the winding spindle with the empty tube thereon is rotated to a starting position of the winding range, a yarn transfer device swings into the yarn path between the empty tube and the full package, so that the yarn partially loops about the empty tube. After a positioning device has lifted the yarn out of the yarn traversing device and guided the yarn into a catching position, the yarn is caught in a slot of the empty tube. Thus, the yarn transferring procedure starts only when the spindle turret has reached the starting position of the winding range.

It is therefore an object of the invention to improve the initially described yarn winding machine in such a manner that the transfer of the yarn from the full package to the empty tube occurs in the shortest time possible. A further object of the invention lies in that during the transfer the yarn tension fluctuates as little as possible.

SUMMARY OF THE INVENTION

The above and other objects and advantages of the present invention are achieved by the provision of a yarn winding machine for winding a continuously advancing yarn wherein the transfer of the yarn from a full package to an empty tube occurs during the rotation of the spindle turret. With that, it is possible to start the transfer procedure before reaching the starting position of the winding range, and to catch the yarn on the empty tube before reaching the starting position. To this end, the yarn transfer device of the winding machine swings from an idle, position to a deflecting position, which is defined by a stop mounted to the spindle turret. The stop is positioned such that the yarn deflected by the transfer device loops around the empty tube with a minimum looping that is needed for catching. Subsequently, the yarn extends from the contact roll to the empty tube and thence, via the deflecting position of the yarn transfer device to the full package. The yarn transfer device contacts the stop in a frictional engagement such that the location of the deflecting position changes along with the rotation of the spindle turret. With that, the relation between the empty tube and the deflecting position remains substantially constant, so that the looping of the yarn about the empty tube remains essentially unchanged. In this phase, the yarn can be transferred from the full package to the empty tube.

The yarn transfer device may include an extension which, in the deflecting position, rests against the stop for sliding movement therealong. This has the advantage that the relative movement between the spindle turret and the yarn transfer device proceeds without generating substantial frictional forces. The extension facing the stop could additionally be provided on its surface with a protection against wear.

The stop may have a curved stop surface, which permits realizing a particularly gentle transfer of the yarn. The curved stop surface provides that the relation between the empty tube and the deflecting position is variable. Thus, it is possible to adjust at the start of the transfer procedure a minimal looping of the yarn about the empty tube, which increases during the rotation of the spindle turret. Only after the positioning device has guided the yarn into the catching position will the rotation of the spindle turret attain on the empty tube the looping, which is necessary for catching the yarn. In this process, the yarn tension undergoes slight fluctuations.

A particularly advantageous further development of the winding machine provides that a nonrotating push-off ring on the spindle turret forms the stop. With that, it is possible to position the deflecting position at a small distance from the empty tube, so that the looping of the empty tube necessary for catching is attained already by a relatively small deflection of the yarn.

Even in the deflecting position, the yarn advances, while being traversed, onto the full package. To this end, a rocker arm of the yarn deflection device is arranged outside of the traversing range and mounts a yarn deflection bar that has a guiding edge extending over the length of the package. Thus, the traversed yarn is able to slide within the traverse stroke along the guide edge, and it can thus be deposited on the full package without forming a tie-off bead. Only after the positioning device has lifted the yarn out of the traversing device will a tie-off bead be wound on the full package, whose position is dependent on the location of the positioning device.

Within the traverse stroke at the package end adjacent the catching slot, the guiding edge is defined by a guide groove or a yarn guide which has a leading edge transverse of the guiding edge. This renders it possible to locate the catching position of the yarn, which is predetermined by the positioning device, outside of the traverse stroke without the advancing yarn slipping from the full package. Thus, the yarn is guided in the catching position along the leading edge of the guide groove or the leading edge of the yarn guide. The leading edge is formed substantially at a right angle to the guiding edge and defines the traverse stroke at the package end facing the catching slot. To transfer the yarn, the positioning device can thus guide the yarn outside of the traverse stroke to a catching position, so that the yarn advances from the catching position obliquely over the empty tube to the deflecting position. In so doing, the yarn reaches the area of the catching slot in the empty tube. In the time during which the yarn is guided along the leading edge of the guide groove or the leading edge of the yarn guide, a tie-off bead is wound on the full package.

After the catching slot in the empty tube has engaged the yarn, the yarn length between the empty tube and the full package is tensioned by the rotation of the winding spindles until the yarn ruptures. To prevent, in particular in the case of yarns with coarse deniers, the yarn from leaving again the catching slot of the empty tube due to the applied tension, a yarn cutter may be provided at a location transverse of the leading edge at a distance from the guiding edge. As soon as the yarn is caught on the empty tube, the yarn length between the empty tube and the full package is guided away from the yarn deflection bar along the leading edge of the yarn guide, until the yarn reaches the yarn cutter and is cut.

The yarn guide preferably includes a slide-off edge which is substantially transverse to the leading edge and which extends from the leading edge over the length of an end zone of the traverse stroke. This provides the advantage that the yarn transfer device can be moved, irrespective of the particular position of the yarn, within the traverse stroke to the deflecting position. The yarn that is in the end zone when the yarn deflection bar swings in, is able to arrive safely at the deflecting position via the slide-off edge of the yarn guide.

Since a decrease of the traverse stroke for the yarn deposited on the full package is necessary only at the moment when the yarn is caught, the yarn guide may be designed for rotation by a rotatable device on the yarn deflection bar from an idle position to a guiding position. In the guiding position, the traverse stroke is reduced. However, while the yarn guide is in its idle position, it is possible to deposit the yarn over the entire winding length of the full package.

To make sure that the yarn transfer device can be moved in the deflecting position by rotating the spindle turret without losing the contact between the yarn transfer device and the stop, it is necessary that the yarn transfer device lie against the stop with a minimum force. However, the minimum force is so small that it does not oppose a significant resistance to the continuing rotation of the spindle turret. In a particularly preferred further development of the winding machine, this minimum force is applied by the drive itself.

However, it is also possible to apply the minimum force irrespective of the drive by a spring engaging the yarn transfer device.

The winding machine of the present invention is especially advantageous by having yarn transfer device arranged for rotation on the support of the contact roll. With that, the movement of the contact roll support produces in addition a parameter to vary the yarn looping about the empty tube, while the yarn is being guided in the deflecting position on the yarn transfer device. For example, by lowering the contact roll support, the yarn looping about the empty tube is increased.

BRIEF DESCRIPTION OF THE DRAWINGS

In the following, several embodiments of the invention are described in more detail with reference to the attached drawings, in which.

DETAILED DESCRIPTION OF THE PREFERRED EMBODIMENTS

Figure 1:
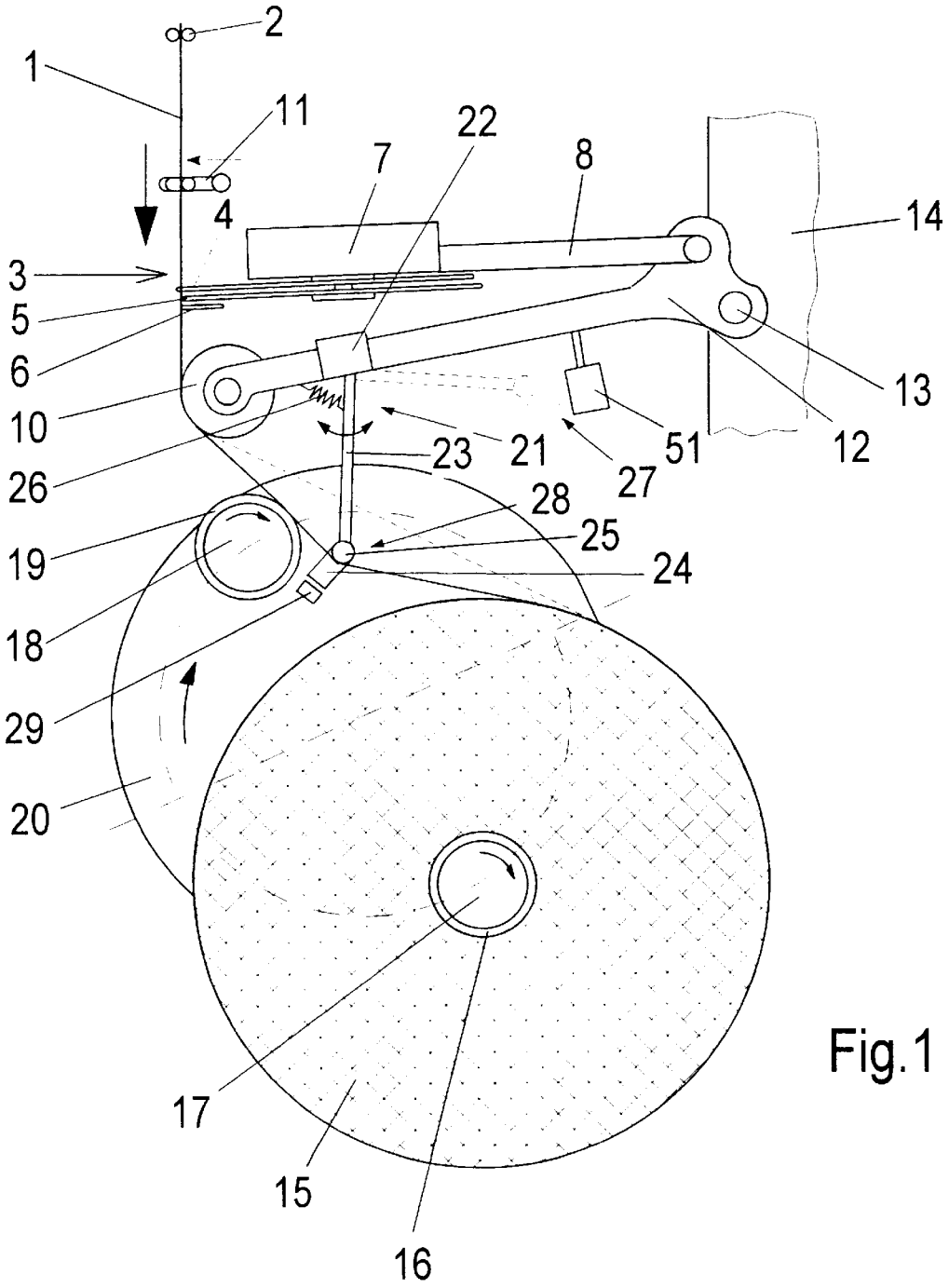
FIGS. 1 and 2 are each a schematic side view of a yarn winding machine according to the invention and shown during a yarn transfer.

In all embodiments of the yarn winding machine according to the invention, a yarn 1 advances continuously at a constant speed to the winding machine. To begin with, the yarn 1 advances through a yarn guide 2 that forms the apex of a traversing triangle. Subsequently, the yarn reaches a traversing device 3, which is constructed as a so-called rotary blade traversing system. In this traversing system, the yarn 1 is traversed by means of two oppositely rotating blades 4 and 5 along a guide bar 6. In so doing, the one rotary blade assumes the guidance in the one direction and then moves below the guide bar 6, while the other rotary blade assumes the guidance in the other direction and then moves below the guide bar 6. The rotary blades 4 and 5 are driven by two rotors that are interconnected by a gearing, and by a drive 7. A support arm 8 mounts the traversing device 3.

Downstream of the traversing device, the yarn 1 is deflected on a contact roll 10 by more than 90° and then wound on a package 15. During the winding operation, the contact roll 10 lies against the surface of package 15.

A winding spindle 17 is mounted off center for rotation on a rotatable spindle turret 20. An electric motor (not shown) drives the winding spindle 17. About 180° offset from winding spindle 17, the spindle turret 20 mounts off center for rotation a second cantilevered winding spindle 18. In the illustrated position, the winding spindle 18 supports an empty tube 19, and the winding spindle 17 supports the package 15 which is wound on tube 16. Likewise, an electric motor (not shown) drives the winding spindle 18.

The spindle turret 20 is rotatably mounted in the machine frame 14 of the winding machine, and it is rotated by a drive in the direction indicated by an arrow. The drive serves to rotate the spindle turret 20 in the sense of enlarging the center to center distance between the contact roll 10 and the winding spindle 17 as the package diameter increases during the normal operation with the contact roll lying against the package surface. The control of the spindle turret proceeds as a function of the diameter of package 15.

The contact roll 10 is rotatably mounted with its shaft 9 on a support 12. At the opposite end, the contact roll support 12 pivotally connects to the machine frame 14 by means of a pivot bearing 13. Thus, the contact roll 10 is capable of performing a movement in a radial direction with respect to the package 15. The contact roll 10 connects to a motor 50 that drives the contact roll 10 at a constant circumferential speed. The contact roll support 12 connects to the support arm 8. This ensures that during the movement of the contact roll the spacing between the contact roll and the traversing device remains unchanged. A pressure relieving device 51 engages the contact roll support 12. This pressure relieving device acts from the bottom against the weight of contact roll 10 and its support 12, so that the contact pressure between contact roll 10 and package 15 can be adjusted. However, the pressure relieving device serves likewise to raise the contact roll 10 from package 15.

FIGS. 1–5 show embodiments of the winding machine according to the invention, each in a position that illustrates the transfer of the yarn from the full package 15 to an empty tube 19. To this end, the contact roll 10 is raised from the package surface by means of pressure relieving device 51, and the winding spindle 17 with package 15 is rotated by means of spindle turret 20 from the winding range toward the transfer range. At the same time, the winding spindle 18 with empty tube 19 rotates from the transfer range to the winding range. To bring the yarn advancing from the contact roll 10 to the full package 15 into contact with the empty tube 19 rotated into the winding range, a yarn transfer device 21 is provided on the takeup machine, which swings into the yarn path [in the direction] between the empty tube 19 and the full package 15 from an idle position 27 to a deflecting position 28.

Figure 2:
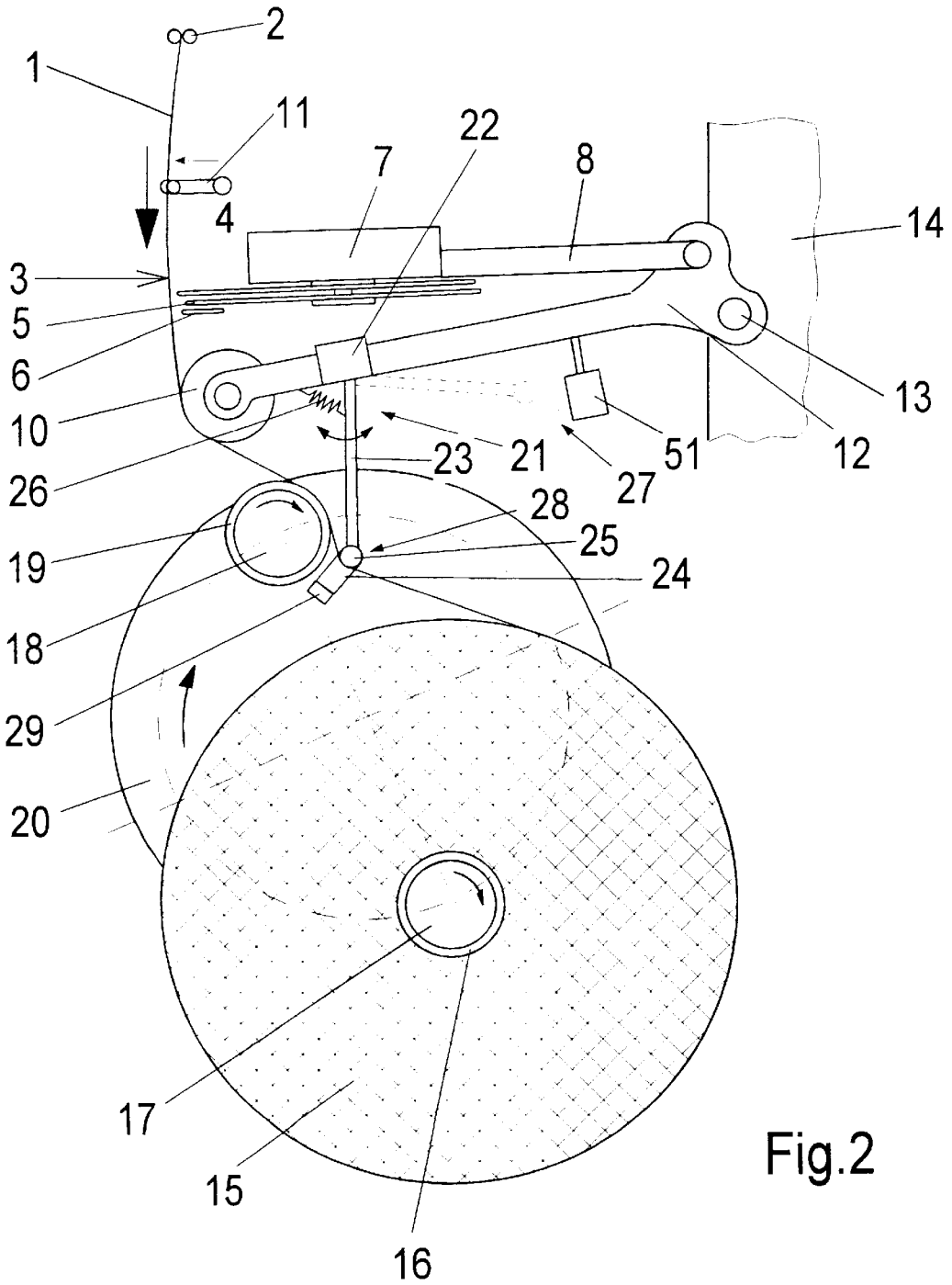
Figure 3:
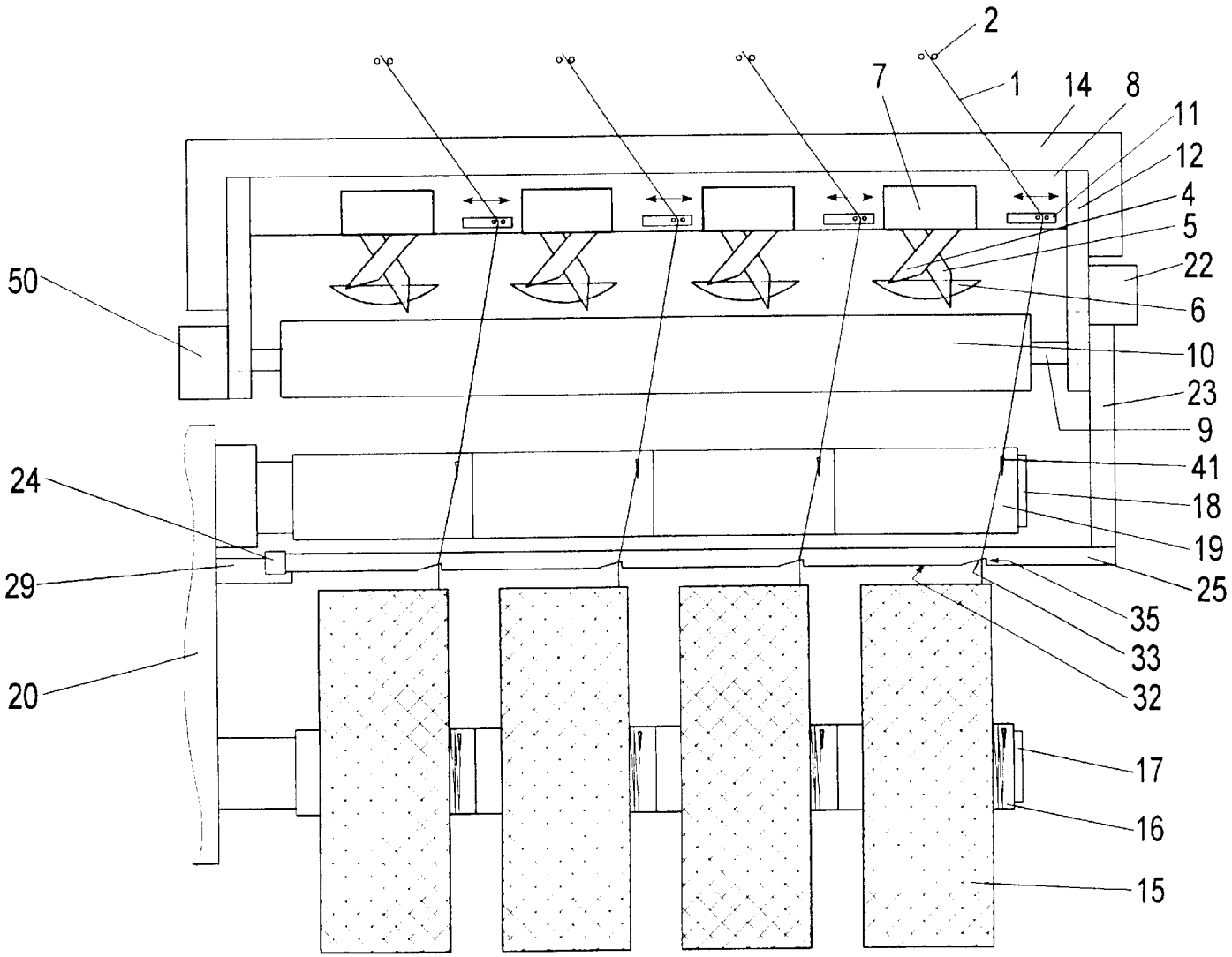
FIG. 3 is a schematic front view of the winding machine of FIGS. 1 and 2.

In the takeup machine of FIGS. 1–3, the yarn transfer device 21 comprises a rocker arm 23 and a yarn deflection bar 25. The rocker arm 23 connects with its one end to a pivot drive 22. At its other end, it mounts the yarn deflection bar 25. The pivot drive 22 and the rocker arm 23 are shown as being arranged on the contact roll support 12. However, they may also be mounted to a support stationarily connected to the machine frame. Outside the traverse range, the yarn deflection bar mounts an extension 24. In the deflecting position 28, the extension 24 lies against a stop 29. FIG. 1 illustrates the situation shortly before a contact is made. The stop 29 is mounted on the spindle turret 20. The rocker arm 23 connects to a spring 26, so that the extension 24 lies against the stop 29 under the load of the spring. The yarn deflection bar 25 has a guiding edge 32 facing the yarn. The guiding edge extends substantially over the entire length of the package (FIG. 3). In the region of the package end that faces a catching slot 41 of tube 19, the yarn deflection bar 25 accommodates a guide groove 33. The guide groove 33 has a leading edge 35 that extends substantially crosswise to the guiding edge 32. Thus, it becomes possible to guide the yarn 1 reciprocating along the guide edge 32 only as far as the leading edge 35 of guide groove 33. This narrows the traverse stroke for depositing the yarn on the package 15. The spacing between the package end and the plane of the leading edge forms an end zone, in which the yarn cannot be deposited.

In the region of traversing device 3, a positioning device 11 is arranged with a movable yarn guide. The positioning device facilitates raising the yarn 1 from the range of action of the traversing device and moving it thereafter to a catching position.

When transferring a yarn, the operation of the takeup machine of FIGS. 1–3 is as follows:

In FIG. 1, the winding spindle 17 with full package 15 is rotated out of the winding range. While the spindle turret 20 rotates the winding spindles 17 and 18, the pivot drive 22 of yarn transfer device 21 is activated, so that the rocker arm 23 swings from its idle position 27 to its deflecting position 28 that is defined by stop 29. Consequently, the yarn deflection bar 25 deflects the yarn 1 between the contact roll and its point of contact on the full package 15 to its deflected position. The yarn now advances from contact roll 10 to yarn deflection bar 25. In this process, the yarn partially loops about the empty tube 19 in the region between the contact roll and the yarn deflection bar. The yarn 1 continues to be in the traversing device 3 and, thus, reciprocates within the traverse stroke. In so doing, the yarn advances along the guiding edge 32 of the yarn deflection bar. The winding spindles 18 and 17 are driven in counterclockwise direction.

FIG. 2 shows the winding machine of FIG. 1, wherein the winding spindles 17 and 18 have assumed a changed position due to the rotation of the spindle turret 20. The deflecting position 28 is changed to the same extent. Thus, the relations between winding spindle 18 and deflecting position 28 of yarn deflection device 21 remain substantially unchanged, so that the yarn loops about the empty tube 19 to about the same degree. The positioning device 11 has now lifted the yarn out of the traversing device 3 and moved it to a catching position.

The path of the yarn is shown in FIG. 3. FIG. 3 illustrates a winding machine with a plurality of winding positions (shown are four). Since the advance of the yarn for its transfer from the full package to the empty tube proceeds in the same way in each of the winding positions, the transfer of the yarn is described with reference to one winding position. The positioning device 11 is in the catching position outside of the traversing range. While the positioning device 11 moves to the catching position, the yarn 1 slides along the guiding edge 32 of the yarn deflection bar to the leading edge 35 of guide groove 33. The catching position of positioning device 11 is now outside of the traversing range offset from leading edge 35 in such a manner that the yarn 1 assumes an oblique advance as shown in FIG. 3. In so doing, the yarn advances into the region of catching slot 41 of the empty tube 19. As shown in FIG. 2, the direction of movement of the yarn is the same as the direction of movement of driven empty tube 19. Therefore, the here-described operation is named common rotational catching.

As soon as yarn 1 is caught by the catching slot 41 in empty tube 19, the yarn length between empty tube 19 and full package 15 is tensioned by the rotation of winding spindles 17 and 18, and ruptures. The positioning device 11 now returns the yarn 1 to the traversing device. In so doing, a so-called waste wind is wound on the empty tube 19. Meanwhile, the spindle turret 20 has rotated the winding spindle 18 with empty tube 19 to the starting position of the winding range. After the first layers are wound on the empty tube, the contact roll 10 is brought into contact with the package being newly wound by means of pressure relieving device 51 that engages contact roll support 12. The yarn transfer device 21 has already been rotated by pivot device 22 to its idle position 27. A new winding cycle can start. The full package 15 is now ready for doffing.

Figure 4:
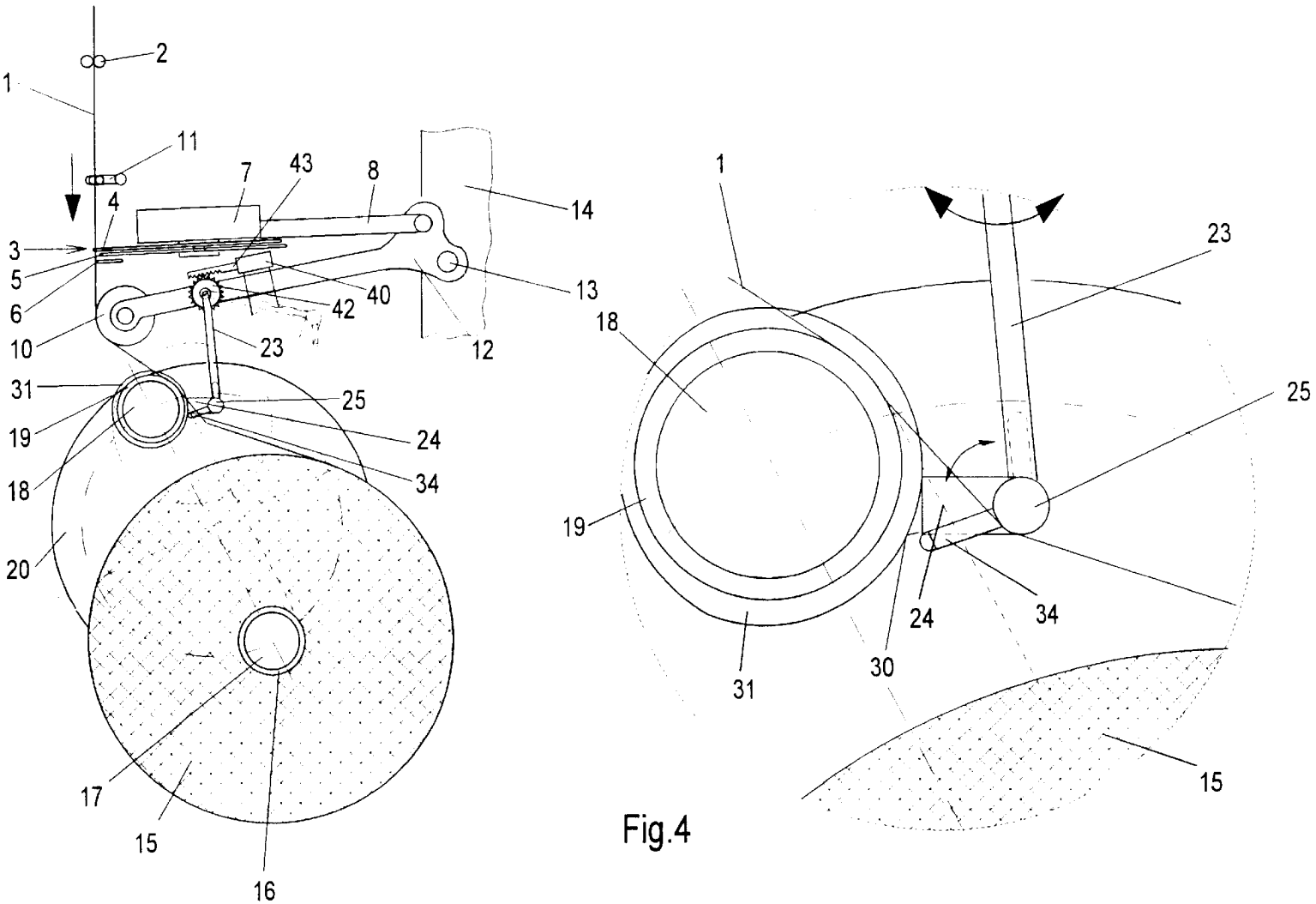
FIG. 4 is a schematic side view of a further embodiment of the winding machine according to the invention during the transfer of the yarn.
Figure 5:
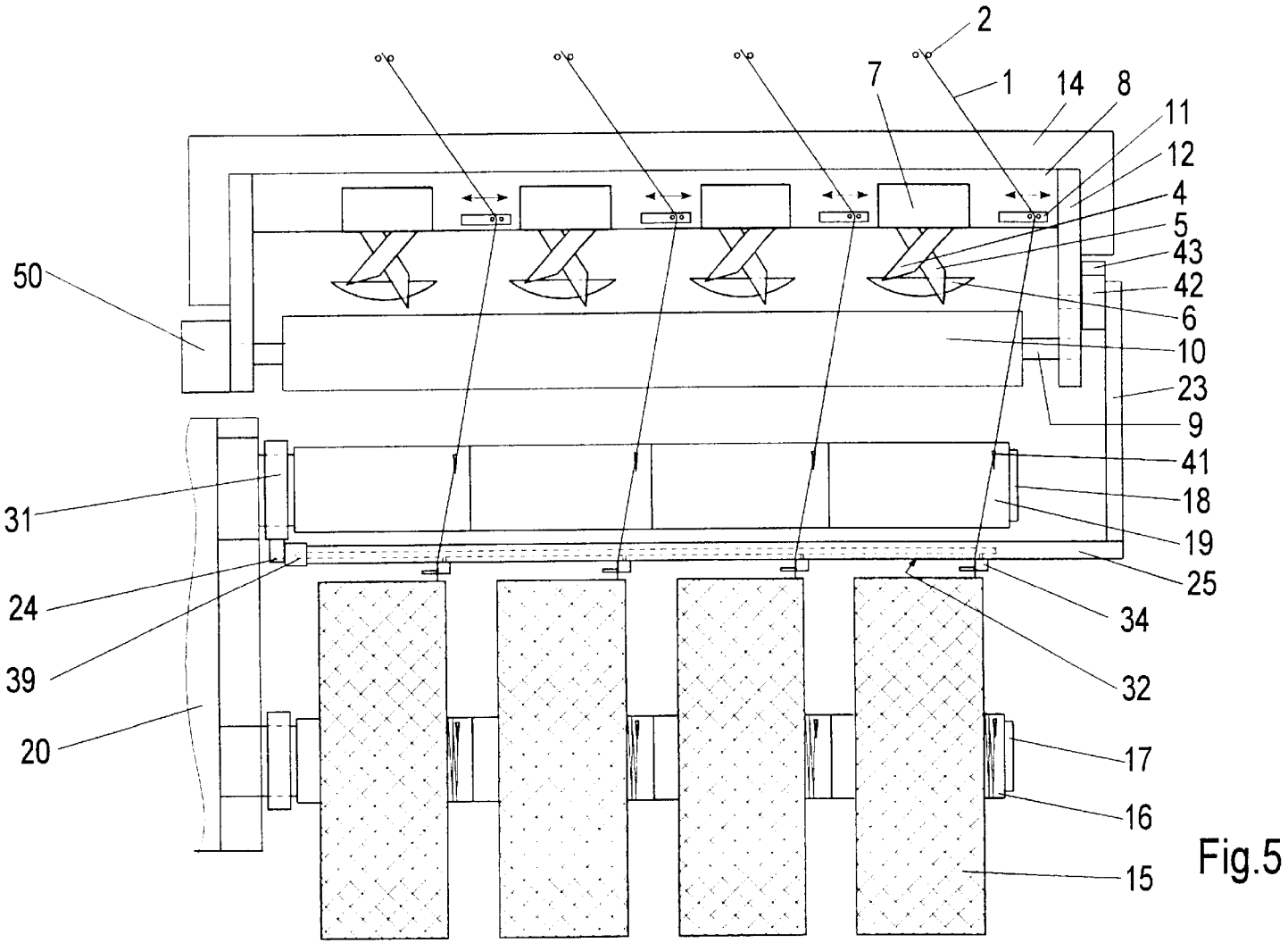
FIG. 5 is a schematic front view of the winding machine of FIG. 4.

FIGS. 4 and 5 illustrate a further embodiment of a winding machine of the same construction as the takeup machine of FIGS. 1–3. Therefore, the description of FIG. 1–3 is herewith incorporated by reference. In the case of the yarn transfer device 21 shown in FIG. 4, the rocker arm 23 connects to a pinion 42. The pinion 42 is rotatably supported on contact roll support 12. The pinion 42 meshes with a rack 43, which is moved by a piston-cylinder unit 40 in such a manner that the rocker arm 23 mounted to pinion 42 swings from idle position 27 to deflecting position 28. In this takeup machine the stop is formed by a push-off ring 31 that is nonrotatingly arranged on the winding spindle 18 at the bearing end thereof. The push-off ring 31 has a curved stop surface 30, so that extension 24 slides along stop surface 30 as the rotation continues. The curved stop surface 30 permits increasing the degree of looping along with the rotation of the spindle turret. This arrangement makes it possible that a very small degree of looping of the yarn on empty tube 19 is initially adjusted at the beginning of the transferring phase. Only after the spindle turret has rotated the winding spindle 18 approximately to the starting position of the winding range, is the looping of the yarn reached, which is necessary for catching same on the empty tube. This arrangement permits decreasing fluctuations of the yarn tension as occur during the transferring procedure. To keep the yarn 1 securely on the full package 15 while the positioning device moves to the catching position, the yarn deflection bar 25 mounts a yarn guide 34. The yarn guide 34 connects to a rotary drive 39 that rotates the yarn guide on yarn deflection bar 25 from an idle position to an operating position. Thus, it is possible to deposit the yarn over the full length of the package until its removal from the traversing device. Only after the positioning device 11 has lifted the yarn out of the traversing device 3, will the yarn guide 34 rotate to its operating position. Thereafter, the previously described catching procedure can start.

The push-off ring 31 also serves to push the full packages from the winding spindle. To this end, a push-off fork extending on a cylinder (not shown) engages push-off ring 31.

Figure 6:
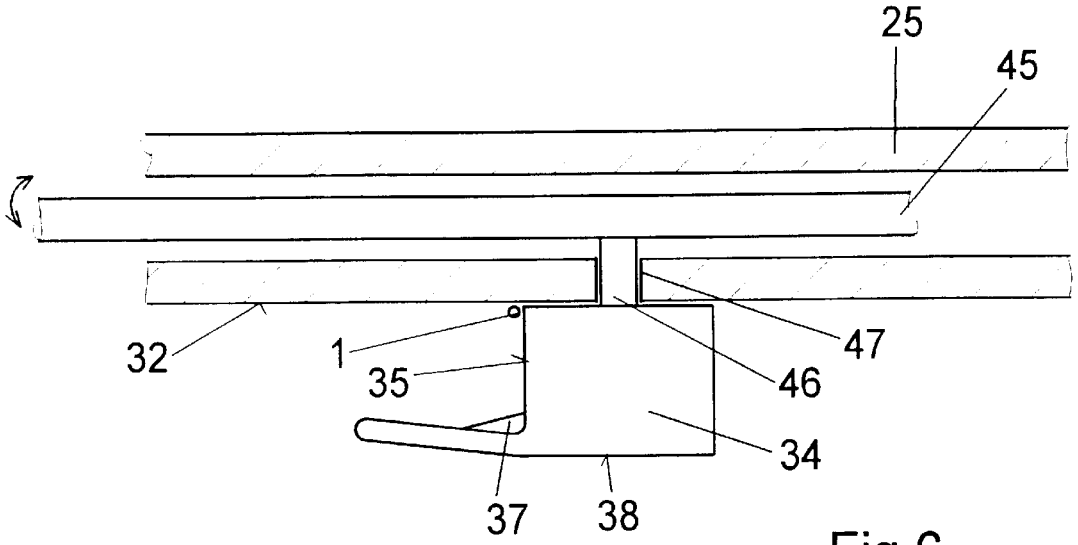
FIG. 6 is a cross sectional view of a yarn deflection bar with a rotatable yarn guide.

As shown in FIG. 6, in the catching position of positioning device 11, the yarn 1 is guided on the leading edge 35 of yarn guide 34. The yarn deflection bar 25 is made hollow-cylindrical. Its jacket surface includes an elongate hole 47. Through this elongate hole 47, a pin 46 extends that is connected to yarn guide 34. In the interior of yarn deflection bar 25, the pin 46 connects to a shaft 45. The shaft 45 inside the yarn deflection bar is coupled with the rotary drive.

After the yarn 1 is caught on the empty tube, the rotation of winding spindle 18 will cause the yarn 1 to slide along leading edge 35, until it reaches a yarn cutter 37 arranged at a distance from the guiding edge 32 of the yarn deflection bar. The yarn cutter 37 causes the yarn 1 to be cut. The spacing between guiding edge 32 and yarn cutter 37 is selected such that it also permits a transfer in the case of a very small wound diameter of package 15, as shown by the yarn path in phantom lines of FIG. 4. In the case of the path of the yarn shown in phantom lines in FIG. 4, the yarn is not guided along the guiding edge of the yarn deflection bar. The natural yarn advance between the contact roll and the package 15 wound at a small diameter effects already the looping necessary for catching on the empty tube 19.

In the extension of guiding edge 32, the yarn guide 34 has a parallel arranged slide-off edge 38. The slide-off edge 38 is sufficiently long that it covers the traverse stroke or the package length in the region of the end zone, thereby ensuring that a yarn being in the end zone of package 15 can reach unimpeded the region of leading edge 35.

In the winding machine shown in FIG. 5, it would be possible to provide the extension 24 arranged on the yarn deflection bar as a contact switch. The contact switch is coupled with the rotary drive 39. As soon as the contact switch comes into contact with the push-off ring 31, the rotary drive will energize and rotate the yarn guide 34 from its idle position to its operating position. Likewise, the winding machine of FIG. 5 is again shown with a plurality of winding positions arranged side by side. To this end, the yarn deflection bar 25 mounts a plurality of spaced-apart yarn guides 34, which connect via a common shaft to the rotary drive 39.

Figure 7:
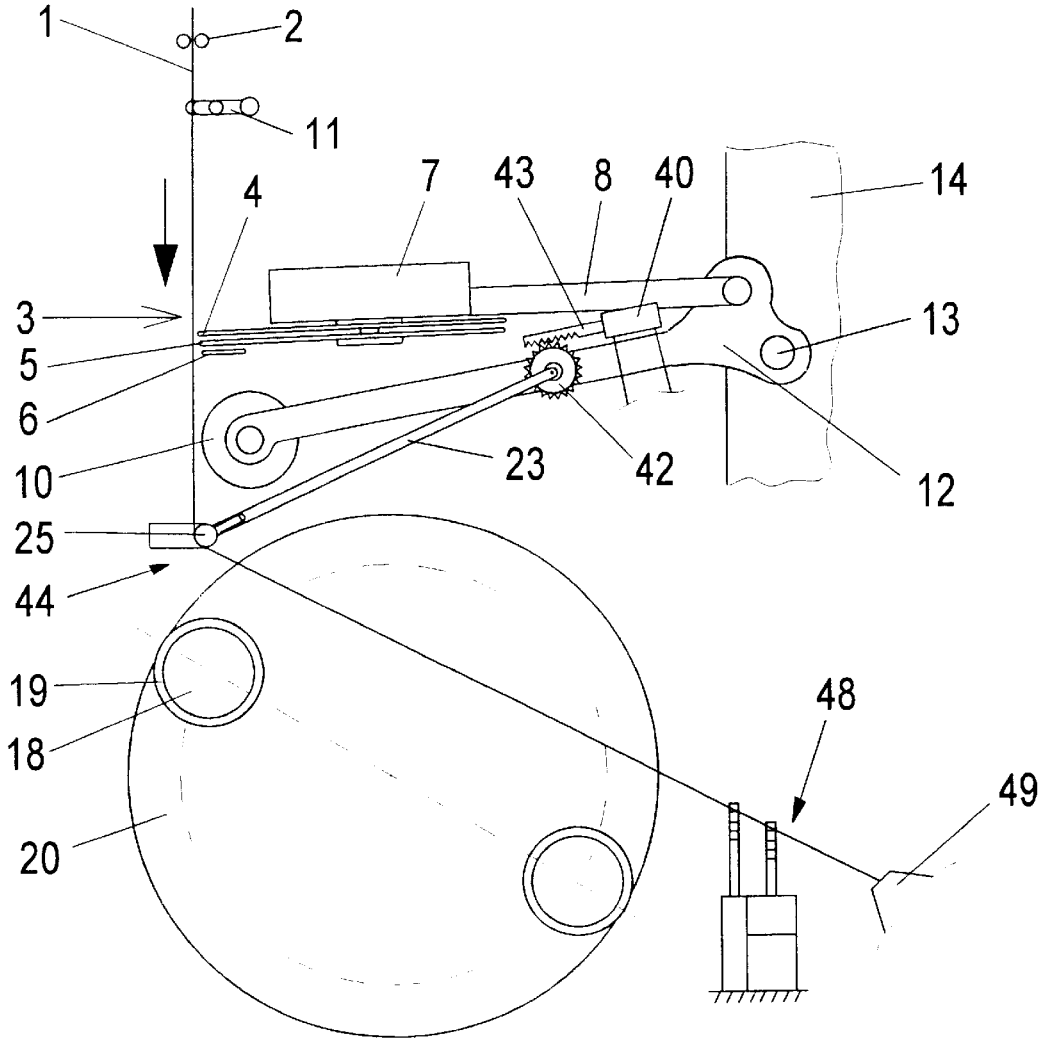
FIG. 7 is a schematic view of the takeup machine of FIG. 1 during an initial threadup of the yarn.

FIG. 7 illustrates the winding machine of FIG. 4 during an initial threadup of the yarn. In this process, the yarn transfer device 21 swings from its idle position 27 to a threadup position 44. In the threadup position 44, the yarn 1 is removed from the region of the traversing device and from the region of the contact roll. The yarn 1 advances along the guiding edge 32 of yarn deflection bar 25 to a yarn stringup gun 49. By means of stringup gun 49, the yarn is inserted into a threadup device 48. The threadup device 48 comprises an alongside movable yarn guide that brings the yarn or yarns to a threadup position. After the yarn 1 has reached the threadup position, the yarn transfer device 21 will swing from the threadup position to the deflecting position. At the same time, the spindle turret rotates with winding spindle 18 and empty tube 19 into the yarn path. The yarn that is received by positioning device 11 and moved to the catching position during the rotation of the yarn transfer device, will then be caught, as previously described, on the empty tube 19. After the yarn is caught on the empty tube 19, the winding cycle will start. The pressure-relieving device 51 brings contact roll 10 into contact with the package being newly wound.

In the threadup position, the yarn guide 34 is in its idle position. Thus, the yarn is able to slide along guiding edge 32 on yarn deflection bar 25.

What is claimed is:

1. A yarn winding machine for winding a continuously advancing yarn to a package, and comprising a machine frame, a spindle turret mounted for rotation to the machine frame, a traversing device mounted to the machine frame, a contact roll mounted for rotation to the machine frame downstream of the traversing device, and two winding spindles mounted off center for rotation on the spindle turret, wherein for purposes of transferring the yarn from a full package mounted on the one winding spindle to an empty tube mounted on the other winding spindle by rotating the spindle turret, the winding spindle with the full package is rotated from a winding range to a transfer range and the winding spindle with the empty tube from the transfer range to the winding range, wherein for a transfer from the full package to the empty tube, the yarn is guided between the full package and the empty tube by a yarn transfer device, which is movable by means of a drive from an idle position to a deflecting position in the path of the yarn, wherein a positioning device is arranged adjacent the traversing device for guiding the yarn for its transfer from the traversing device to a catching position, in which the yarn advances through a catching slot arranged in the empty tube, and wherein the deflecting position of the yarn transfer device is defined by a stop arranged on the spindle turret, and the yarn transfer device is in frictional engagement with the stop in such a manner that the location of the deflecting position is variable with the rotation of the spindle turret.

2. The yarn winding machine of claim 1, wherein the yarn transfer device comprises an extension that rests in the deflecting position against the stop for sliding movement therealong.

3. The yarn winding machine of claim 1, wherein the stop has a curved stop surface.

4. The yarn winding machine of claim 3, wherein the stop is formed by a non-rotating push-off ring that is arranged for axial movement on the winding spindle for pushing off the full package.

5. The yarn winding machine of claim 1, wherein the yarn transfer device comprises a rocker arm pivotally supported on the machine frame and a yarn deflection bar mounted to the free end of the rocker arm, which yarn deflection bar defines a guiding edge extending over the length of package, and which guides the yarn in the deflecting position with the guiding edge.

6. The yarn winding machine of claim 5, wherein within a traverse stroke at the package end adjacent the catching slot, the guiding edge is defined by a guide groove or a yarn guide with a leading edge transverse of the guiding edge in such a manner that the traversed yarn cannot be deposited in an end zone formed between the package end and the leading edge.

7. The yarn winding machine of claim 6, wherein the leading edge of guide groove or the leading edge of yarn guide communicates with a yarn cutter which is aligned substantially parallel to and spaced from the guiding edge.

8. The yarn winding machine of claim 6, wherein the guiding edge is defined by a yarn guide and the yarn guide comprises a slide-off edge substantially transverse of the leading edge, which slide-off edge extends at least from the end of the leading edge over the length of an end zone of the traverse stroke.

9. The yarn winding machine of claim 8, wherein the yarn guide is mounted for rotation by a rotating device on the yarn deflection bar from an idle position to a guiding position.

10. The yarn winding machine of claim 9, wherein the yarn transfer device further comprises an extension which extends transversely to the yarn deflecting bar, and wherein the extension of the yarn transfer device includes a contact switch, which activates upon contact with the stop the rotating device for moving the yarn guide to its guiding position.

11. The yarn winding machine of claim 1, wherein the drive of the yarn transfer device is a piston-cylinder unit, which moves a rack engaging a pinion connected to the yarn transfer device, and which generates a minimum force necessary for the contact of yarn transfer device with the stop.

12. The yarn winding machine of claim 1, wherein the yarn transfer device connects to a spring, which generates a minimum force necessary for the contact of yarn transfer device with the stop.

13. The yarn winding machine of claim 1, wherein the yarn transfer device is mounted for rotation on a contact roll support, and wherein the contact roll support itself is arranged for movement on the machine frame, so that the position of the contact roll is variable.

14. The yarn winding machine of claim 1, wherein during an initial yarn threadup, the yarn transfer device is rotatable from its idle position to a threadup position, with the yarn transfer device guiding the yarn in the threadup position outside of the traversing device and the contact roll.

15. Method of transferring a yarn from a full package to an empty tube in a yarn winding machine having a traversing device and two winding spindles mounted off center for rotation on a spindle turret for receiving the full package and the empty tube, wherein during the winding the yarn lies against the circumference of a contact roll before it advances onto the full package, wherein by rotating the spindle turret the full package is rotated from a winding range to a transfer range and the empty tube from the transfer range to the winding range, wherein the empty tube is brought into contact with the yarn advancing onto the full package, wherein between the empty tube and the full package the yarn is guided by a yarn transfer device in a deflecting position that causes a looping of the yarn about the empty tube, wherein a positionable yarn guide guides the yarn for its transfer from the traversing device to a catching position, in which the yarn advances through a catching slot arranged in the empty tube, and wherein the deflecting position of the yarn transfer device is varied by the movement of the spindle turret in such a manner that the degree of the looping of the yarn about the empty tube is controllable.

* * * * *